United States Patent [19]

Lakin

[11] 4,030,238

[45] June 21, 1977

[54] ROTATING TOYS, PARTICULARLY FLYING TOYS

[76] Inventor: Willis M. Lakin, P.O. Box 234, Rte. 2, Roselle, Ill. 60172

[22] Filed: May 4, 1976

[21] Appl. No.: 683,053

[52] U.S. Cl. ..... 46/86 R; 46/83; 46/75

[51] Int. Cl.[2] ..... A63H 11/06; A63H 13/02

[58] Field of Search ..... 46/86 A–86 C, 46/86 R, 60, 74 R, 74 A–74 C, 82, 84, 85; 244/122 AC, 122 AE, 138, 147, 150

[56] References Cited

UNITED STATES PATENTS

| | | | |
|---|---|---|---|
| 2,051,151 | 8/1936 | Northrop | 46/86 R |
| 2,887,819 | 5/1959 | Hausser et al. | 46/83 |
| 3,704,540 | 12/1972 | Montagu | 46/75 |

*Primary Examiner*—J. N. Eskovitz
*Assistant Examiner*—Mickey Yu
*Attorney, Agent, or Firm*—Larson, Taylor and Hinds

[57] ABSTRACT

An improved rotating toy, particularly a flying toy, with a centrifugal force responsive release mechanism comprising locking means for retaining an object, such as a parachute, within a receptacle in a first locked position, and centrifugal force responsive means for releasing the object from the first locked position in response to a first level of centrifugal force and maintaining the object in a second locked position until the level of centrifugal force decreases to a second level of centrifugal force.

15 Claims, 2 Drawing Figures

ROTATING TOYS, PARTICULARLY FLYING TOYS

FIELD OF THE INVENTION

This invention relates generally to improvements in rotating toys such as flying toys and, more particularly, to centrifugal force responsive release mechanisms therefore for releasing an object therefrom.

BACKGROUND AND SUMMARY OF THE INVENTION

A popular feature of toys, and in particular, flying toys, is the provision for release or ejection of an object from the toy during operation thereof. In the case of toys, it is known to employ centrifugal force responsive release mechanisms. An example of such devices is disclosed in U.S. Pat. No. 3,051,151, issued to J. K. Northrop, wherein a spring loaded hinged cover is locked by means of a hinged arm which is maintained in a locking position by centrifugal force. However, such prior art devices suffer from a number of limitations. Of primary importance is the fact that such devices must be used with specially designed launchers which hold the locking arm in the locked position until sufficient rotation of the toy is attained. As a consequence, mounting of the toy on the laucher is complicated. Of equal, if not greater, importance is the fact that such prior art devices do not include toy-mounted means for maintaining the locking arm in a locked position prior to rotation of the toy. Nor is there any provision for ensuring that the locking arm remains locked should the toy prematurely disengage from the launcher before sufficient rotation is imparted thereto to maintain the locked position by action of centrifugal force.

These and other disadvantages of the prior art are overcome by the improved toy constructed according to the present invention, which comprises locking means for retaining an object within a receptacle for the object in a first locked position, and centrifugal force responsive means for releasing the object from the first locked position in response to a first level of centrifugal force and maintaining the object in a second locked position until the level of centrifugal force acting on the centrifugal force responsive means diminishes to a second level of centrifugal force. In a preferred embodiment, the locking means may comprise a lip formed in the object, an opposing lip formed in the object receptacle, and spring means for urging the object lip against the receptacle lip. The centrifugal force responsive means may comprise a plurality of spaced lever arms disposed about the circumference of the object receptacle and pivotably mounted such that one portion of each lever arm swings outwardly about its pivot point in response to centrifugal force, thereby causing the other portion to swing inwardly into the receptacle. The inwardly swinging portions of the lever arms are constructed and arranged such that when the lever arms respond to centrifugal force the inward end of at least one of the inwardly swinging lever arm portions acts against to object to disengage the object lip from the object receptacle lip, the inwardly swinging lever arm portions act to center the object within the receptacle in the second locked position, and the inwardly swinging portions of the lever arms coact with the object lip to effectuate locking of the object within the receptacle in the second locked position.

In a preferred embodiment of the invention, the base of the object may be constructed and arranged so as to receive the spring (preferably a helical spring) such that the spring is prevented from disengaging from the base when the object is released from the first locked position. The object base may define an annular recess and be provided with a centrally disposed conical projection for guiding the spring end into the recess. Additionally, the inward ends of the inwardly swinging portions of the lever arms may be configured so as to conform to the external shape of the object, the outwadly swinging portions of the lever arms may be weighted, the spring means may be unsupported over a substantial portion of its length, and the object receptacle may be provided with a plurality of spaced ribs projecting thereinto for guiding the object into alignment with the spring means. Further,the object lip may be provided with a ring of elastomeric material so configured and arranged that the receptacle lip abuts thereagainst when the object lip and receptacle lip are urged together by the spring means. The receptacle may also be sectioned into first and second sections joined together end to end with the lever arms arms being mounted on stub shafts rotatably mounted in recesses formed in the surface of at least one portion of the receptacle section ends that are joined together. The receptacle sections may also be joined together by complementary fastening means, including a detent-like arrangement.

Other features and advantages of the invention will be set forth in, or apparent from, the detailed description of a preferred embodiment found hereinbelow.

DETAILED DESCRIPTION

Although a helicopter embodiment of the improved toy constructed according to the present invention will be described, it is to be understood that the present invention may be employed in any toy, some portion of which is caused to rotate during operation of the toy.

Figure 1:
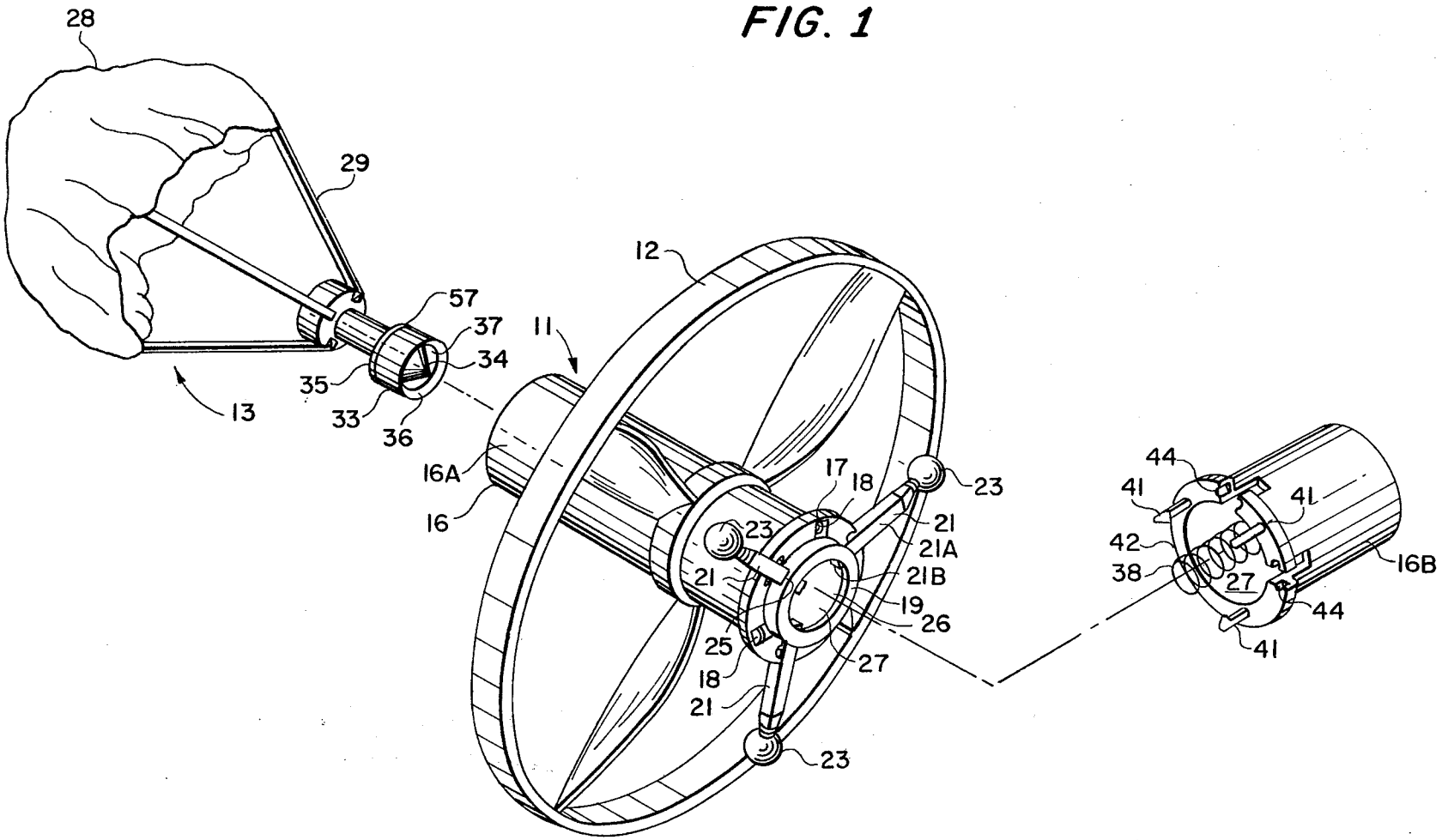
FIG. 1 is a partially exploded perspective view of a preferred embodiment of an improved toy constructed according to the present invention.
Figure 2:
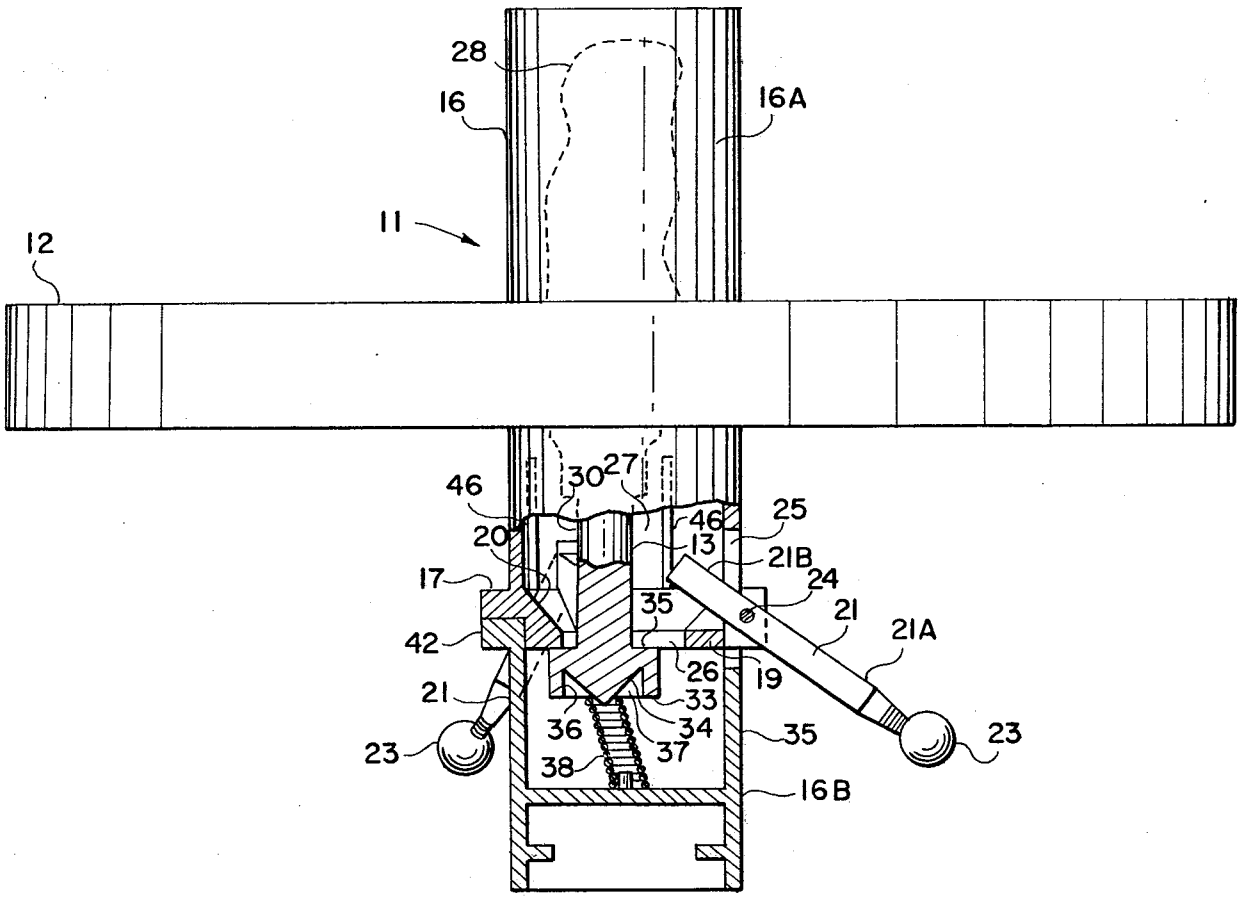
FIG. 2 is a side elevation, partially in section and partially cut away, of the embodiment of FIG. 1, with certain details omitted for the sake of clarity.

Referring to FIGS 1 and 2, a conventional toy helicopter, generally denoted 11, is shown, and basically comprises a rotor assembly 12 mounted on a shaft 16 and having pitched blades. As shown, shaft 16 may comprise two sections, 16A and 16B, connected together end to end, in order to facilitate manufacture. The base 16B of shaft 16 is adapted for use with conventional launchers (not shown), which impart rotational spin to the helicopter. Examples of such conventional launchers may be found in U.S. Pat. Nos. 3,704,540, 2,802,299 or 2,051,151.

Shaft 16 is hollow, defining a bore 27 for receiving an object, generally denoted 13. Object 13 is provided with an upwardly-facing lip 35 protruding therefrom, which in the exemplary embodiment shown is defined by the portion of the upper surface of base 33 which extends beyond shaft 30. Lip 35 may also be provided with an elastomeric pad 57 thereon, as shown in FIG. 1. The bottom surface of base 33 has a centrally disposed conical projection 34 and a peripheral wall 36 defining an annular recess or groove 37 therebetween. Object 13 may be equipped with, for example, parachute 28, connected to object 13 by means of arms 29. Arms 29 may be pivotably connected to object 13, as shown.

A helical compression spring 38 is fixedly mounted at its base within bore 27 of base 16B, in coaxial alignment with the longitudinal axis of shaft 16. Spring 38 is unsupported over a substantial portion of its length, such that when compressed there is a tendancy for spring 38 to become canted or tilted, as shown in FIG. 2.

Bore 27 has disposed therein a downwardly facing lip 19 extending inwardly from the wall of shaft 16 and defining an annular opening 26 with a diameter slightly greater than that of base 33 of object 13. The wall of shaft 16 may also be provided with a plurality of inwardly projecting, longitudinally oriented ribs 46, and/or an inwardly slanting ramp surface 20 extending from the wall of shaft 16 to the edge of lip 19 defining opening 26, in order to guide object 13 into alignment with opening 26 and spring 38 upon insertion of object 13 into bore 27.

Three lever arms 21 are pivotally mounted on shaft 16 proximate lip 19 in coplanar relationship and equally spaced from one another. Lever arms 21 are mounted such that portions 21A will swing outwardly from shaft 16 in response to centrifugal force, thereby causing portions 21B to swing inwardly about the fulcrums defined by mounting axles 24 into bore 27 through openings 25 provided in the wall of shaft 16. Lever arm portions 21B are configured such that when portions 21A are swung outwardly to a first predetermined angle with respect to the longitudinal axis of shaft 16, object 13, which has been previously inserted into bore 27 in a manner to be described hereinbelow, will be cammed into substantial coaxial alignment with the longitudinal axis of shaft 16 and lever arm portions 21B will be at least partially overlap and engage object lip 35, and hence retain object 13. Lever arm portions 21A are of a length and weight such that object 13 will be released by lever arm portions 21B when, as will be explained more fully hereinbelow, the centrifugal forces generated by rotation of helicopter 11 have decreased to a predetermined level, thereby allowing lever arm portions 21A to swing inwardly to a second predetermined angle. In this connection, lever arm portions 21A may be provided with enlarged end portions 23, which may be weighted by metal balls. In addition, the inward ends of lever arm portions 21B may be configured so as to conform to the external shape of the object. For example, in the embodiment shown, object 13 is generally cylindrical, and lever arm portions 21B have concave inward ends.

In order to facilitate manufacture of the improved toy of the present invention, lever arms 21 may be pivotably mounted between flanges 17 and 42 of sections 16A and 16B, respectively, of shaft 16 of axles 24 which are rotatably mounted in grooves 44 in flanges 17 and 42, as shown. In addition, sections 16A and 16B may be fastened together by means of detent-like members 41 (FIG. 1), which pass through openings 18 in flange 17 and coact with the upper face of flange 17.

Although the operation of an improved top constructed according to the present invention should be apparent from the above description, the operation will now be described. Object 13 is inserted into bore 27 of shaft 16 base first until base 33 engages the distal end of spring 38. Ribs 46 and/or ramp surface 20 serve to guide the base 33 of object 13 into alignment with opening 26 and spring 38. Conical projection 34 on base 33 ensures that the end of spring 38 will engage recess 36, thus centering spring 38 stably on the base 33.

Object 13 is then further inserted into bore 27 of shaft 16 by means of a substantially vertical downward force, possibly having a lateral force component, compressing spring 38 until object lip 35 is relatively below bore lip 19. Due to the lateral instability of the substantially unsupported spring 38, spring 38 becomes canted, as shown. In canting, spring 38 applies a lateral force component to object 13, which causes object 13 to be displaced outwardly toward the edge of bore 27. When so displaced, object lip 35 is a relative alignment with some portion of bore lip 19, such that when the force being applied to insert object 13 into bore 27 is removed, spring 38 urges object lip 35 into engagement with bore lip 19. Object 13 is then in a first locked position, wherein the object 13 is positively held within bore 27 and is prevented from being released therefrom until a lateral force is applied to displace object 13 toward the center of bore 27, and disengage lips 19 and 35.

Once object 13 is in the first locked position, the helicopter 11 is ready to be launched by imparting a rotational spin thereto, in any conventional manner. When a rotational spin is imparted to helicopter 11, the centrifugal forces thereby generated cause portions 21A of lever arms 21 to swing outwardly away from shaft 16. Portions 21B swing inwardly about the pivot point defined by axles 24 into bore 27. In swinging inwardly, at least one of the lever arm portions 21B engages object 13 and pushes it toward the center of bore 27. When lever arms 21 have attained a predetermined angle with respect to the longitudinal axis of shaft 16, object 13 will be substantially centered within bore 27, and object lip 35 will no longer be in relative alignment with bore lip 19. Lip 35 will have cleared lip 19, and object 13 will move upwardly under the spring force unitl lip 35 abuts the inner ends 21B of arms 21. Object 13 is then in a second locked position, wherein object 13 is prevented from being released from bore 27 by the engagement of object lip 35 with lever arm portions 21B.

Object 13 is maintained in the second locked position until the centrifugal forces acting on lever arms 21 decrease to the point where the downward acting forces being applied to object 13 through lever arm portions 21B are insufficient to overcome the upward acting forces being applied to object 13 by spring 38, and lever arm portions 21A have swung inwardly sufficiently to allow lever arm portions 21B to disengage from object lip 35. Object 13 is then released from bore 27, propelled by the forces generated by compressed spring 38. The level of centrifugal force at which the object 13 is released is determined according to well known principles by the moment of inertia of lever arm portions 21A, the relative lengths of lever arm portions 21A and 21B, and the compressional force generated by spring 38. Since the rotational speed of the helicopter determines its rate and height of climb, the device is easily designed so as to effect launching of the parachute substantially at the top of the flight or thereafter or therebefore.

It will be appreciated by those skilled in the art that althrough the invention has been described relative to an exemplary embodiment thereof, modifications and variations can be effected in this embodiment without departing from the scope and spirit of the invention.

I claim:

1. In a toy wherein at least some portion thereof is caused to rotate during operation of the toy, the improvement comprising an object adapted to be released from said toy, means for receiving said object, locking means for retaining said object in a first locked position within said object receiving means, and centrifugal force responsive means for releasing said object from said first locked position upon attainment of a first level of centrifugal force and maintaining said object in a second locked position until the level of centrifugal force acting on said centrifugal force responsive means diminishes to a second level of centrifugal force.

2. The rotatable toy improvement of claim 1 wherein said locking means comprises a first lip formed in said object, an opposing second lip formed in said object receiving means, and spring means for urging said object lip against said object receiving means lip.

3. The rotatable toy improvement of claim 2 wherein the base of said object is constructed and arranged to receive said spring means such that said spring means is prevented from disengaging from said base when said object is released from said first locked position.

4. The rotatable toy improvement of claim 3 wherein the base of said object defines an annular recess.

5. The rotatable toy improvement of claim 4 wherein the base of said object is provided with a centrally disposed conical projection for guiding said spring means into said recess.

6. The rotatable toy improvement of claim 1 wherein said object receiving means comprises a bore, and said centrifugal force responsive means comprises a plurality of spaced lever arm disposed about the circumference of said object receiving means and pivotably mounted thereon such that one portion of each lever arm swings outwardly about its pivot in response to centrifugal force, thereby causing the other portion to swing inwardly into said bore, the inwardly swinging portions of said lever arms being constructed and arranged such that when the lever arms respond to centrifugal force the inward end of at least one of the inwardly swinging lever arm portions acts against said object to disengage said first lip from said second lip, the inwardly swinging lever arm portions act to center the object within the bore of the object receiving means in the second locked position, and the inwardly swinging portions of the lever arms coact with the first lip to effectuate locking of the object in the second locked position.

7. The rotatable toy improvement of claim 6 wherein the ends of the inwardly swinging portions of the lever arms are configured so as to conform to the external shape of said object.

8. The rotatable toy improvement of claim 7 wherein the ends of the outwardly swinging portions of the lever arms are weighted.

9. The rotatable toy improvement of claim 2 wherein said spring means is a helical compression spring fixedly mounted at its base and unsupported over a substantial portion of its length.

10. The rotatable toy improvment of claim 6 wherein said object receiving means includes a plurality of spaced ribs projecting into said bore for guiding said object into said bore in alignment with said spring means.

11. The rotatable toy improvement of claim 2 wherein said first lip is provided with a ring of elastomeric material so configured and arranged that said second lip abuts thereagainst when said lips are urged together by said spring means.

12. The rotatable toy improvement of claim 6 wherein said object receiving means is sectioned into first and second sections joined together end to end, the ends joined together having complementary fastening means, and said lever arms being mounted on stub shafts rotatably mounted in recesses formed in the surface of at least one of said ends joined together.

13. The rotatable toy improvements of claim 12 wherein said complementary fastening means comprises a detent-like member on one of said section ends and an opposing surface on the other of said section ends.

14. The rotatable toy improvement of claim 6 wherein said object is displaced upwardly by said spring means upon release of said object from said first locked position, such that said first lip is above said second lip when said object is in said second locked position.

15. The apparatus as claimed in claim 1 wherein said toy comprises a flying toy having a plurality of propeller blades extending outwardly from a hollow shaft and pitched to provide aerodynamic lift when said flying toy is rotated; said object comprising an elongated member with attached parachute, said elongated member having an enlarged base portion forming a first upwardly-facing lip; said means for receiving said object comprising an opening in one end of said shaft communicating with the bore of said shaft, said shaft having a raised annular surface circumferentially disposed on the inner wall of said shaft, said raised surface forming a second, downwardly-facing lip; said locking means including a helical compression spring fixedly mounted at its base, and standing proud, unsupported over a substantial portion of its length, beneath said second lip, said spring urging said first lip against said second lip into said first locked position by the insertion of said object into said bore such that the base of said elongated member engages the distal end of said spring, and said spring is compressed to allow said first lip to be disposed below said second lip; and said centrifugal force responsive means comprising three equidistantly spaced lever arms disposed about the circumference of said shaft and pivotably mounted thereon such that one portion of each lever arm swings outwardly about its pivot in response to centrifugal force, thereby causing the other portion to swing inwardly into said bore, the inwardly swinging portions of said lever arms being constructed and arranged such that when the lever arms respond to centrifugal force the inward end of at least one of the inwardly swinging lever arm portions acts against said object to disengage said first lip from said second lip, the inwardly swinging over arm portions act to center the object within the bore of the object receiving means in the second locked position, and inwardly swinging portions of the lever arms coact with the first lip to effectuate locking of the object in the second locking position.

* * * * *